US006267130B1

(12) United States Patent
Konda

(10) Patent No.: US 6,267,130 B1
(45) Date of Patent: Jul. 31, 2001

(54) ASSEMBLY AWNING STRUCTURE

(76) Inventor: Katherine R. Konda, 2509 Wild Rose, Arlington, TX (US) 76006

( * ) Notice: Subject to any disclaimer, the term of this patent is extended or adjusted under 35 U.S.C. 154(b) by 0 days.

(21) Appl. No.: 09/358,571

(22) Filed: Jul. 16, 1999

(51) Int. Cl.[7] ..... E04H 15/44

(52) U.S. Cl. ..... 135/133; 135/128; 135/149; 52/74; 160/56; 160/83.1

(58) Field of Search ..... 135/128, 133, 135/135, 132, 136, 147, 121, 124; 52/74; 160/45, 56, 57, 76, 77, 83.1, 352

(56) References Cited

U.S. PATENT DOCUMENTS

| | | | | |
|---|---|---|---|---|
| 925,231 | * | 6/1909 | Sanders | 160/56 |
| 1,650,111 | * | 11/1927 | Byne | 135/133 |
| 2,551,975 | * | 5/1951 | Scott | 160/56 |
| 5,842,495 | * | 12/1998 | Egnew et al. | 135/133 |
| 5,927,363 | * | 7/1999 | Olsen | 160/83.1 |

FOREIGN PATENT DOCUMENTS

| | | | | |
|---|---|---|---|---|
| 444816 | * | 2/1949 | (IT) | 160/45 |

* cited by examiner

*Primary Examiner*—Blair M. Johnson
(74) *Attorney, Agent, or Firm*—John F. Bryan

(57) ABSTRACT

A lightweight awning frame having the flexibility of being easily lengthened or shortened by the addition or removal of extension pieces, which is easy and inexpensive to manufacture and mass produce, assemble and install, and package in a relatively compact cardboard box. The awning can be produced in various forms with common requirements of multiple bent pipes and non-welded, one piece engageable members wherein the ends of the pipes are inserted and securely engaged for the purpose of forming a semicircular half-dome shaped structure. Standard left and right end sections having a set of awning tubes can be formed into awning ribs by connection or the addition of extension members and support brackets connected at joints spacing the awning tubes apart in an array of awning ribs. One form of the side brackets has two receiving openings and a flange for securing individual tubes. An alternate form of side brackets is formed of specially configured plates which are notched to permit use of the extreme end of an exposed awning tube which may be placed in an eye bolt to secure the frame structure. Very long large commercial awnings can be produced without the need for welding or special transportation equipment or custom manufacturing facilities. They are disassemblable and may be moved or converted to a different length by the simple removal or addition of standard pieces. The frame may be covered with brightly colored and labeled materials to form an attractive awning.

21 Claims, 9 Drawing Sheets

ASSEMBLY AWNING STRUCTURE

CROSS-REFERENCE TO RELATED APPLICATION

BACKGROUND OF THE INVENTION

1. Field of the Invention

The invention relates to a dome awning frame assembled without welding from parts connected by fasteners to be secured over windows and the like on a vertical wall of a building structure to support an awning cover.

2. Background of the Prior Art

Awnings are increasingly used over residential windows and over glass covered openings in commercial building walls to shield and shade the windows without obstructing the view. Awnings typically have a frame with a plurality of ribs which are spaced apart in an array and fixed in position by means of side brackets and sometimes by connections between the individual ribs and the awning covering material itself, which may be flexible material or even light gauge metal.

Larger awnings are especially useful to cover large expanses of glass in commercial buildings, with a covering that is brightly colored and labeled. Viewed from the side and cross-section the array of ribs is pie-shaped, each of the ribs extending roughly a radial distance from a side bracket where they are connected. Viewed from the front the large commercial awnings have a cylindrical-shape in the center, representing approximately a quarter of a cylinder, and the ends taper down into opposed rounded end sections which are rounded from the top and rounded from the front to have smooth appearance.

Many awnings, especially the larger commercial awnings, are fabricated in a shop remote from the place of installation where the brackets and ribs are joined by welding the metal frame members together to form the ribs and other parts of the support structure. Sometimes the cover is made from metal as well, and welding is often used to make a completely welded assembly which must be shipped in its completed form, a difficult procedure.

Awnings of the aforesaid character are known and sometimes referred to as "dome" or "bubble" awnings and are disclosed in the prior art. Such dome awnings take various forms and directions, and are typically expensive, costly, heavy and difficult to maneuver, and importantly such designs are generally confined to the original choice of length and width and may not be adjusted without complete revision. When the use of connectable welded joints is employed, dome awnings are heavy, and priced by the piece, are expensive. When joint welding processes are employed, dome awnings are expensive to manufacture, heavy to carry and install, and have no ability to be disassembled, are space consuming and difficult to maneuver. This makes it almost impossible for awnings of this type to be mass manufactured and sold in the mass market, because the bulk precludes presenting them to the customer in a compact package.

SUMMARY OF THE INVENTION

The invention disclosed herein is an easy and inexpensive to manufacture, assemblable awning structure, able to be compactly packaged, easy to assemble and install, lightweight dome awning frame having the flexibility of being lengthened or shortened. Basic end sections are provided which may be separated a desired distance apart with extension tubes and support brackets to make an awning of any chosen length. The dome awning can be produced in various forms with common end sections having multiple bent or curved pipes and non-welded, one-piece engageable brackets for securing the ends of the pipes for the purpose of forming semicircular, half-dome shaped structures. The awning structures so formed may be easily disassembled and shipped to a new location. A specially formed side bracket may, with the aid of ordinary fasteners not visible from the outside, hold the awning tubes in a spread apart array of ribs without further supports.

A specialized support bracket having spaced apart grooves for receiving abutting tubes supports joints between opposite side end sections of tube extensions which laterally spread individual side end section tubes and form awning ribs. Fasteners may be inserted from the underside of the support bracket into the tubes to hold them in position. Connector members may be inserted in abutting tube ends to be engaged by fastener means which connect the joints to the support bracket from the underside. It is desirable to fasten without exiting the wall of any rib forming tube so as to interfere with or damage a cover.

The invention contemplates an awning frame made from awning tubes which are vertical oriented as well as horizontally oriented as indicated in the FIGURES. The vertically oriented tubes utilize a top bracket and conveniently employ the specialized support bracket which is connected to the ends of the downwardly and outwardly extending tubes to form the bottom peripheral edge of an awning frame. Similarly, a triangular-shaped frame can be used which conveniently employs the specialized support bracket connected between upper and lower horizontal runs of awning tubes. The support bracket is angled away from a wall surface from the top outwardly and downwardly to form the support for a side of a triangular-shaped frame. The vertically oriented tube frame may also include two end sections and an intermediate section, also having vertically oriented outwardly and downwardly curved tubes which are connected to the same specialized support bracket. In all cases, preferably end tubes, can extend below the support bracket to provide a convenient extension for insertion into a headed fastener mounted in the wall to support and contain the awning frame.

Now even large commercial awnings can be mass produced with only a few different interchangeable parts to produce an almost unlimited range of widths in a particular end design and packaged in a flat compact box which does not require much storage space.

DETAILED DESCRIPTION OF THE INVENTION

Figure 1:
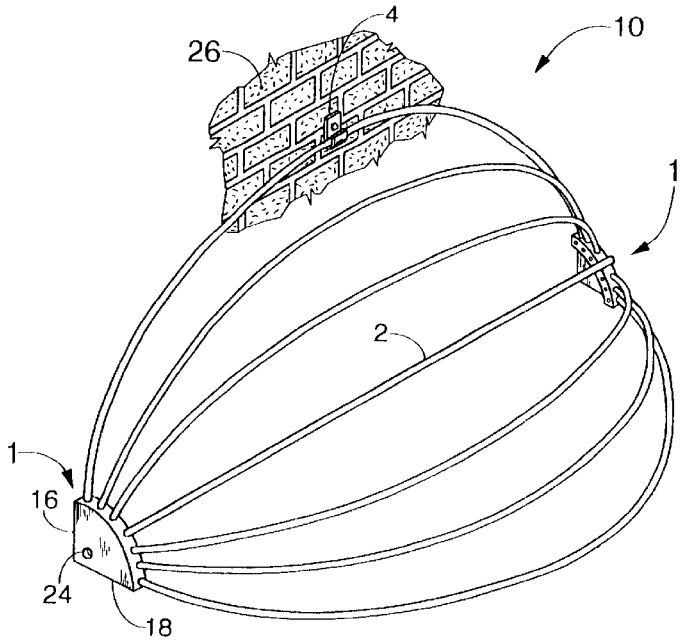
FIG. 1 is perspective of an awning as assembled for covering a small window showing one form of specialized side brackets.
Figure 2:
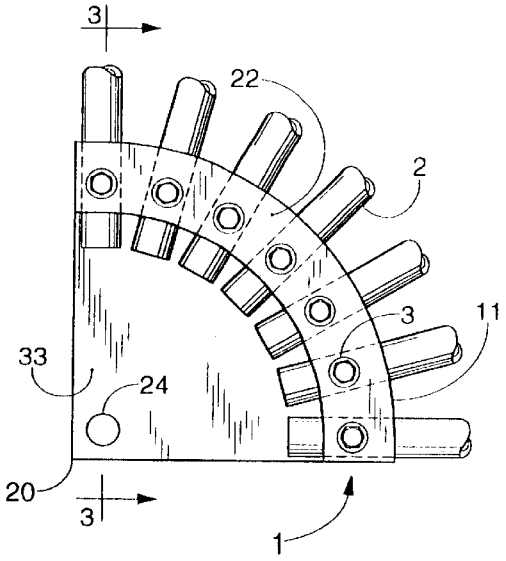
FIG. 2 is a side elevation of the side bracket shown in FIG. 1, seen from the inside.
Figure 3:
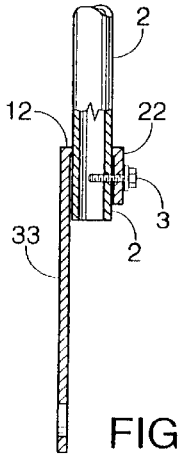
FIG. 3 shows the connection between the tubes of the unit shown in FIG. 1 and the side brackets.
Figure 4:
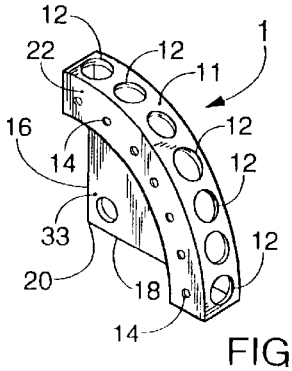
FIG. 4 is a perspective of the side bracket shown in FIGS. 1–3.

Referring to FIGS. 1, 2, 3, and 4 there is shown a dome awning frame generally referred to by the reference numeral 10, in assembled condition. It has side brackets 1 used to join and securely engage the ends of multiple curved pipes or tubes designated by the reference numeral 2. A vertical wall support 4, as shown in FIG. 1, may be used as a hanger for the small awning. Brackets 1 have a tube receiving portion comprising curved top panel 11 with a series of lined up spaced apart tube receiving openings 12. Brackets 1 have a side plate panel 33, and a one piece assembly is preferred as shown in FIGS. 1–4. Curved top panel 11 is a convexly arcuate extension at right angles to side plate 33. The curved top panel 11 with tube end openings 12, referred to as the tube receiving portion, has a depending flange 22. Depending flange 22 may be referred to as a short inside panel, because in assembly it is placed on the inside so that only the outside surface of bracket 33 is seen on the ends of the completed unit, for improved appearance. Depending flange 22 has a series of openings 14 arcuately aligned in assembly to receive screw fasteners 3 which are fastened through an opening in the end portion of a set of awning tubes 2 as indicated in FIGS. 2 and 3.

Side bracket 1 has a wall contacting edge 16 and at right angles thereto an edge that we will refer to as a horizontal edge 18. They meet at an apex 20. An imaginary radial line drawn through apex 20 and the center of a circle formed by each opening 12 passes through the longitudinal screw axis of the screws 3 when they are fastened in the openings 14. This is more clearly seen in FIG. 2. Thus when a plurality of tubes forming a set have their opposed end portions inserted into openings 12 in the tube receiving section of bracket 1, to a small distance below the bottom edge of depending flange 22, and a screw fastener 3 is inserted through opening 14 to secure each of the tube ends to said side plates, the awning tubes are spread into an array of awning ribs.

As such, the fastener openings cooperate with the tube end receiving openings to secure the tubes into the array of awning ribs when fastened. Since the tube ends would have a previously prepared opening for receiving screw fasteners 3, it is seen that simple insertion of the tube ends in each of the holes 12 when fastened by means of screw fasteners 3 in openings 14 produces a desired array without further expertise required on the part of the installer. Thus produced is a self standing dome awning frame when assembled which may be hung by a hanger 4, for support on a vertical wall.

The brackets 1 may have additional brackets (not shown) attached thereto, and to the wall, so that the structure when completed cannot be moved or shifted by the wind. The brackets 1 may also have a notched section of the type indicated in FIG. 5, to be discussed later, which will fit into the head of an eye bolt secure the frame 10 to a vertical wall in the same manner as will be indicated later. Brackets 1 may further include an opening 24 which can be used to tie a flexible cover in place, or it may further serve as a means of securing the brackets 1 to the wall surface. It is easily seen that when the tubes 2 are removed from the brackets 1, they form a flat bundle and may be included in a rather thin shipping box which reduces bulk, reduces transportation cost and requires less inventory storage space.

However, an even more compact arrangement can be visualized if the unit 10 of FIG. 1 is cut in half through the midpoint of the tubes 2 at a place which would be indicated by a plane which would be vertical and perpendicular to the vertical wall 26 in FIG. 1. Then a means for connection can be provided for each of the tubes 2 so that, in assembly, they may be reconnected at their midpoints to form a complete awning tube, and together an array of awning ribs. If the tubes 2 are individually separated, as by severing at their midpoints, they may be reconnectable by means of an internal sleeve and fastener screwed through the tube wall preferably in previously formed openings, into the sleeve member. Alternatively, one end of the severed tubes 2 could be swaged and fitted inside the unswaged end of the opposite half of each tube 2 and secured by fasteners, on the hidden underside, to avoid wear on a canvas cover, for example. Still further, the ends of the tube 2 could be provided with notches 28 as in FIG. 8 and a half-round connector member 30 can be slipped inside the abutted ends of tubes 2 and secured with bolts.

Figure 5:
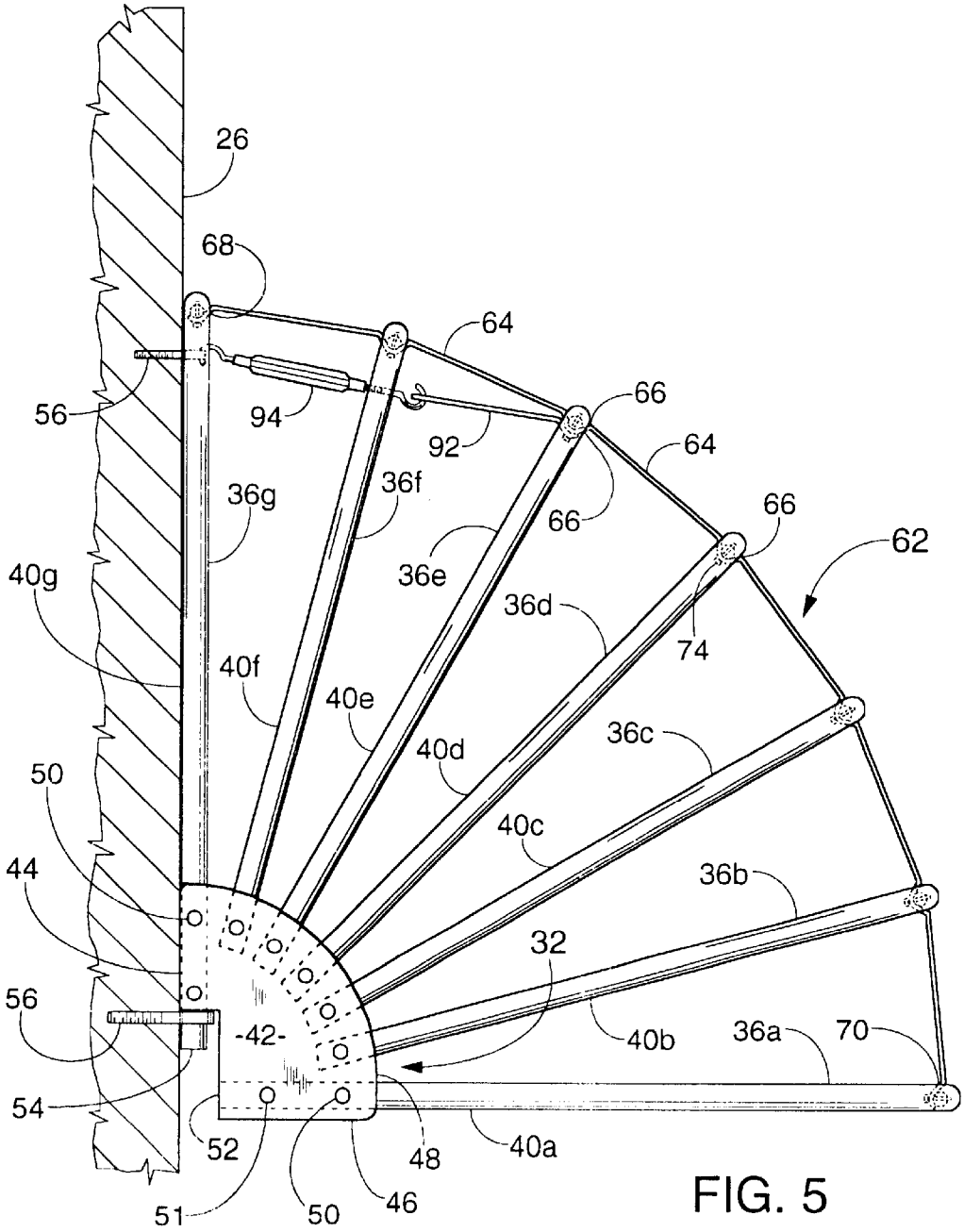
FIG. 5 is a side elevation showing an alternative non-welded awning structure as assembled and installed against a vertical wall.
Figure 6:
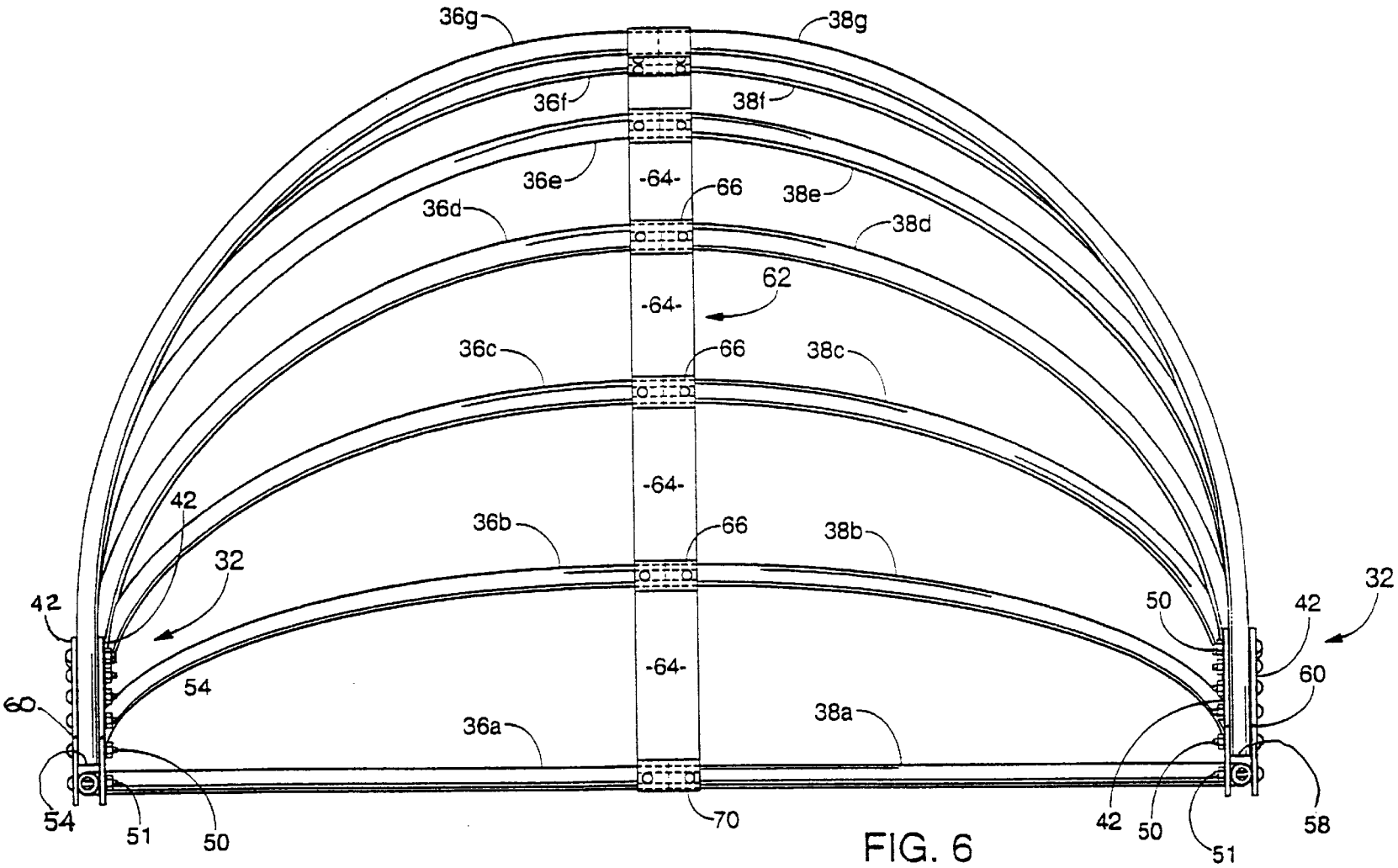
FIG. 6 is a view of the alternative embodiment of FIG. 5 seen from behind looking out from the wall.

An alternate embodiment of a non-welded awning structure which is assemblable with fasteners, is depicted in various forms in FIGS. 5 through 9. In FIG. 5 is seen a side end view of one side of the assemblable structure of the alternate embodiment as assembled, which is a mirror image of the opposite awning tube end section on the other side of the awning structure. That is, as viewed from the front, there is a first awning tube end section having a plurality of curved or bent awning tubes, each having a side bracket end having a fastener opening, and a connector end, together with a first side bracket, generally indicated by the reference numeral 32, on the left side of the awning structure. On the right side of the awning structure will be a second awning tube end section, having a plurality of curved or bent awning tubes each having a side bracket end and a fastener opening, and an opposite connector end, having a second side bracket 32 on the right side. In FIG. 6 the first awning tube section has a plurality of awning tubes 36*a* through 36*g*. A corresponding second awning tube end section as indicated in FIG. 6, has corresponding awning tubes 38*a* through 38*g*. Tube 38*a* corresponds to tube 36*a*, tube 38*b* corresponds to tube 36*b*, etc. By corresponding is meant that the tubes are arranged in the same orientation and connectable to form a complete awning rib. Tubes 36*a* through 36*g* have side bracket end portions 40*a* through 40*g* as indicated in FIG. 5. The end portions are for connection to bracket 32.

First and second side brackets 32 are comprised of a pair of flat plates, configured as indicated in FIGS. 5 and 6, although they could be fabricated from a single piece bent into a "U" shape with a connecting flange. Side plates 42 have a wall contact edge 44 for contacting, a vertical wall surface and bottom edge 46 generally at right angles thereto. Plates 42 have a curved outer edge 48 with an arcuate line of matched fastener openings when the plates are placed side by side as indicated by the line of connecting fasteners 50 in FIG. 5. Plates are matched and placed side by side for fastening on opposite sides against the end portions of the plurality of awning tubes 36*a–g*. Similarly, the second side bracket clamps against the opposite sides of the end portions of awning tubes 38*a–g* of the second awning tube end section.

The side plates, adjacent the wall contacting edge have a means for mounting and demounting the awning structure, when assembled, to an anchor such as an anchor bolt extending from the wall, comprising a notched section 52 that exposes the extreme end portion 54, 58 of the wallmost located awning tube.

Extreme tube ends 54, 58 can be dropped into and lifted out of the protruding eye of an extending anchor bolt 56 to support the awning structure, when assembled, in position against a vertical wall. The side bracket end of the wallmost awning tube 36*g*, 38*g* is preferably extended and fixed to the side bracket with an additional fastener 51. The bottommost awning tube of the first and second end sections, 36*a*, 38*a*, is preferably extended and fastened with an additional fastener 51 between plates 42. It is seen from FIG. 6 that the fasteners 50, 51 pass completely through the adjacently located side plates of the side bracket 32. The bottommost and wallmost awning tubes 36*a*, 38*a*, 36*g*, 38*g*, are generally at right angles to each other and fixed in that position by their connection via bolts or fasteners 50, 51. It is seen that the extreme end 54 of wallmost tube 36*g* and the extreme end 58 of wallmost tube 38*g* extend beyond the rectangular notch 52 so as to conveniently fit into anchor bolt eyes spaced apart horizontally on wall 26, which provides for rapid installation and removal, if necessary. The upper portion 60 of the notch is seen in FIG. 6 as extending beyond the tube to rest upon the eye of anchor bolts 56. Weight is on the end brackets while horizontal force, if any, operates against the extreme end portions of the wallmost tubes to prevent shifting or pulling away from the wall.

Another aspect of the invention illustrated in FIG. 6 is the use of an elongated support bracket 62 although it may be seen that a fractional hemispherical awning might be made with awning tubes not severed in the middle which are continuous from bracket to bracket. Some means would be needed to keep them oriented in a spaced apart array of awning ribs. One way to accomplish this might be to utilize the end brackets 1 previously discussed. Another way might be to extend the ends of the tubes at the bracket end in FIG. 5 and add another row of fasteners interior of the row of fasteners 50 shown therein.

Figure 8:
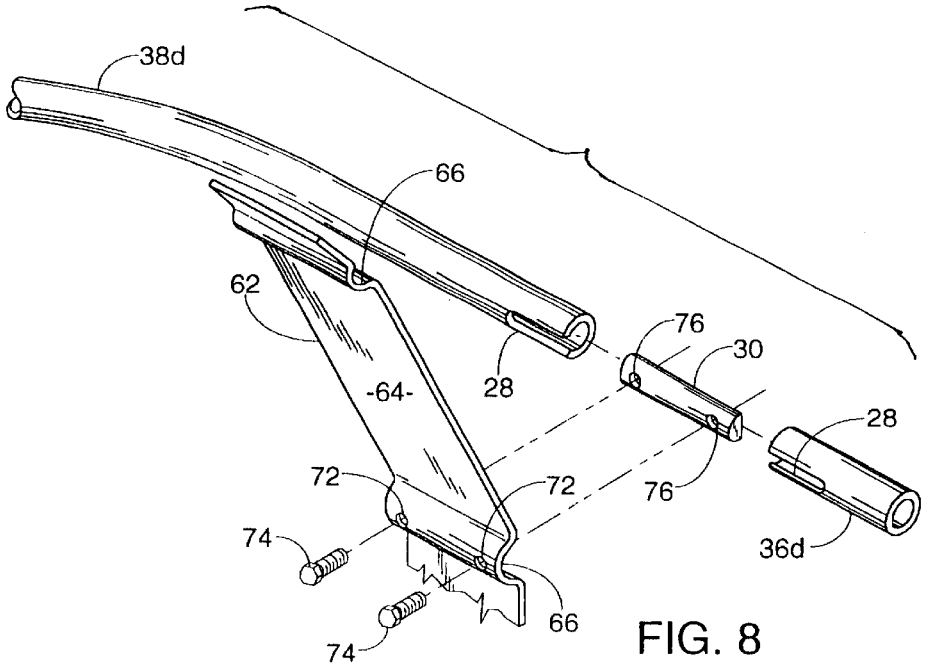
FIG. 8 shows a connection between an end section tube and an extension tube as attached at a support bracket.

However, a superior way to stabilize the tubes into a spaced apart array of ribs, and provide other advantages, is found in the use of elongated support bracket plate 62 also seen in FIG. 5 and a cutaway portion in FIG. 8. Perhaps best seen in FIGS. 5 and 8, bracket plate 62 has a web portion 64 separating two receiving channels 66. The portions 64 and channels 66 alternate along the length of the elongated support bracket 62 which is curved or bent in the form of an arch which takes the shape of the outermost extension of the array of awning ribs. As illustrated, the web portions are relatively flat and bent away from each other at an angle greater than 180° as seen from the outside surface. The extremities of support brackets 62 are formed by cutting away part of the support bracket to form a wallmost tube receiving channel 68 and a bottommost tube receiving channel 70.

A preferable way to utilize the support bracket in connection with the awning tubes is seen in FIG. 8 where the exemplary awning tubes 36*d* and 38*d* are seen in an exploded view and it is to be understood that each of the other tubes will be secured to their corresponding tubes by a means for connection, such as illustrated in FIG. 8. Each of the channels is fitted with spaced apart fastener openings 72 for receiving fasteners 74. Connector member 30 comprises a half-round piece with spaced apart threaded openings 76 for receiving screws 74 after they pass through opening 72 and the support bracket. Connector member 30 is designed to be received in each of the abutting ends of exemplary corresponding mating tubes 36*d*, 38*d* which are abutted over it, the ends each having a slot 28 extending in a longitudinal direction of the axis of the tubes. This permits starting the fasteners 74 in through the opening 72 and into the threaded opening 76 before tightening, which makes it easy to slip the ends of the exemplary tube 36*d*, 38*d* into place over the connector 30. Then the fasteners 74 are tightened and the abutted ends of exemplary tubes 36*d*, 38*d* are secured by friction in one of the channels 66 to form a complete awning rib from side bracket to side bracket, which is spaced apart from the other tubes similarly connected by the spacing between the channels 66 in the support bracket 62.

A completed structure is seen in FIG. 5. Note that the channels 68 and 70 are similarly connected. Though the web portion of the channels 68, 70 has been cutaway so as to not interfere with the wall or be unsightly, the same kind of connection is easily made. It should also be noted that rapid disassembly is equally possible by reversing the process which can remove a damaged rib for example, without disturbing the awning structure proper. Connector member 30 could be made from a solid bar with threaded openings 76 or a tubing sleeve with similar threaded openings which would fit into the ends of the mating abutting tubes to form a connection means with the support bracket. It is also evident that fasteners, such as self tapping fasteners 74, could be inserted through openings 72 and connected directly into openings or threaded openings in the connecting end portions of abutting or overlapping ends of the adjacent tubes or tube extensions that will form individual ribs. The end portions of the adjacent tube ends conveniently lie in grooves 66 and are drawn tight by fasteners which penetrate the tubes and connect them to the elongated support bracket.

Figure 7:
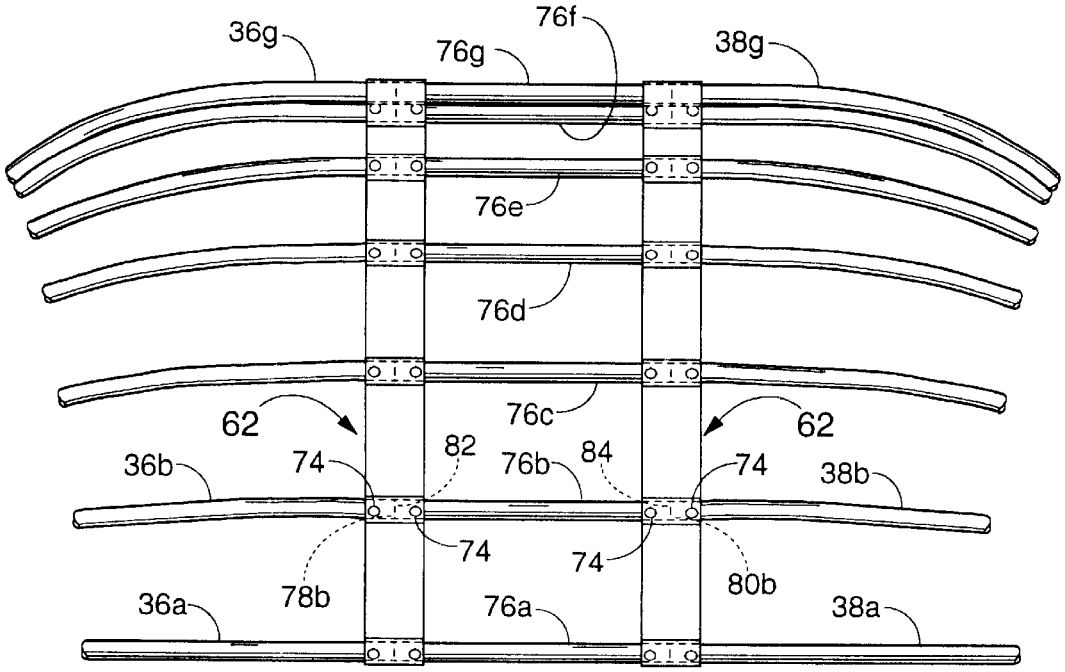
FIG. 7 shows the alternative embodiment of FIGS. 5 and 6 having an extender for extending its length.
Figure 9:
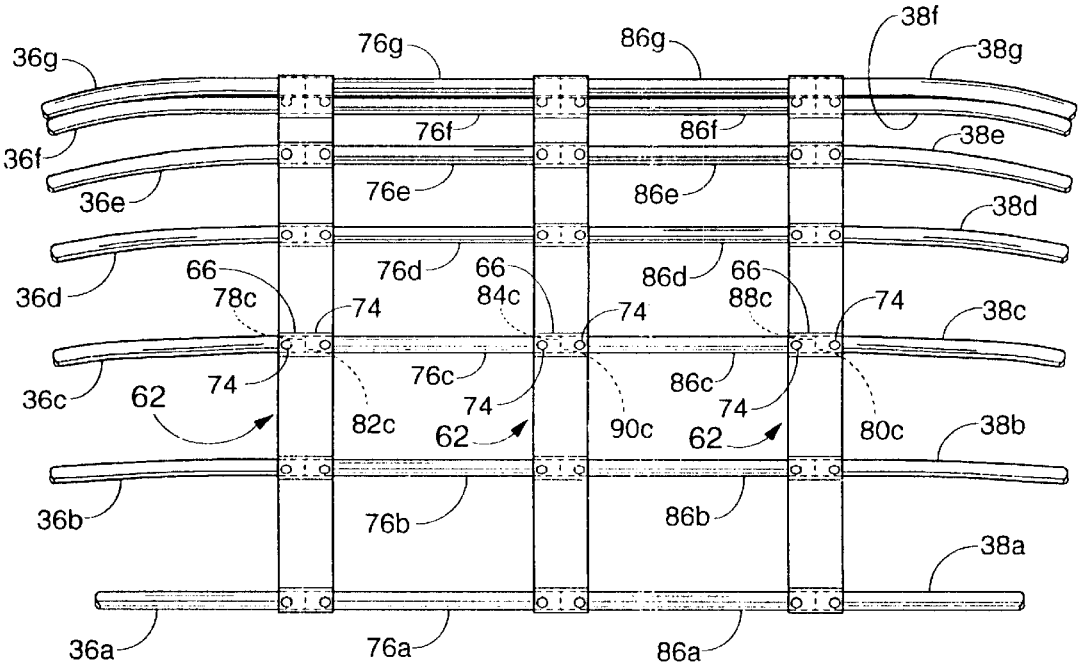
FIG. 9 shows the alternate embodiment of FIG. 5 having two extension tubes connected at a support bracket for making the awning structure longer.

FIGS. 7 and 9 further illustrate the utility of the support bracket in extending the length of an awning by the addition of a plurality of extension awning tubes 76*a–g* as indicated in FIG. 7 intermediate each of a pair of awning tube support brackets 62. On the left side of FIG. 7 is a first awning tube end section having curved awning tubes 36*a–g* and on the right side of FIG. 7 is a second awning tube end section having awning tubes 38*a–g* which are curved into the side brackets as in FIG. 6. Instead of having only a single support bracket for spacing and connection to the abutted corresponding awning tubes 38*a* and 38*b*, 36*b* and 38*b* etc., as in FIG. 6, a pair of support brackets is employed. The severed connector end 78*b* of tube 36*b* is indicated in abutting contact with one end of extension tube 76*b*. The severed connector or support bracket end 80*b* of awning tube 38*b* is in abutting contact with the opposite other end 84 of extension tube 76*b*. The one end 82 of extension tube 76*b* is abutted against end 78*b* of exemplary tube 36*b* and the opposite other end 84 of extension tube 76*b* is abutted against end 80*b* of awning tube 38*b*. The extension tubes 76*a–g* have the same slots 28, have internally the same connector member 30 and the same fastener 74 as illustrated in FIG. 8. All of the other of the awning tubes 36*a–g* are connected in the same way with their corresponding extension tubes 76*a–g* as shown in FIGS. 6 and 8. Similarly, each of the tubes have the same connection to the second elongated support bracket 62 and the opposite abutting ends of extension tubes 76*a–g* as indicated in the discussion of exemplary extension tubes 76*b*. Thus it is seen that each of the corresponding awning tubes 36*b* and 38*b*, and all of the other corresponding tubes, are separated by the length of the extension tubes 76*a–g* which effectively lengthens the awning. The corresponding awning tubes together with each of their corresponding extension tubes form a complete awning rib which in assembly are spaced apart by the distance between the channels 66 into a complete array of awning ribs. The longitudinal separation which lengthens the awning can be much greater than illustrated in FIG. 7 by merely increasing the length of the extension awning tubes so that a considerable distance can be added without decreasing the structural rigidity of the frame thus created.

A further extension of the length of the completed awning frame with a supported array of ribs is illustrated in FIG. 9. FIG. 9 shows the first awing tube end section 36*a–g* and the second awning tube end section 38*a–g* which are spaced apart by a first set of awning tubes 76*a–g* and a second set of awning tube extensions 86*a–g*.

Exemplary awning tube 36*c* from the first awning tube end section and exemplary awning tube 38*c* from the second awning tube end section are seen spaced apart by means of extension awning tube 76*c* and extension awning tube 86*c* with the aid of three elongated support brackets 62. Connector end 78*c* of awning tube 36*c* is placed in abutting relationship with end 82*c* of extension tube 76*c* and connected at a groove 66 in first support bracket 62 as indicated in FIG. 8. Connector end 80*c* of awning tube 38*c* is placed in abutting relationship with end 88*c* of extension tube 86*c*, and fastened in a groove 66 of the third support bracket 62 as illustrated in FIG. 8 in turn, as a linear extension of a tubes 36*c*, 38*c*. The end 90*c* of extension tube 86*c* is abutted against the end 84*c* of extension tube 76*c* and likewise connected at a groove 66 in the middle or second support bracket 62 as illustrated in FIG. 8. Thus is formed a complete rib for the awning structure which further separates, in supported relationship extensions to complete an awning rib. Identical extension tubes 76*a–g* and 86*a–g* are connected in a similar manner to form a complete array of awning ribs which further permits a lengthening of the awning such that it could extend clear across the width of the building. Additional extension tubes together with additional support brackets can provide an awning structure which is assemblable to a very long length.

The use of the support brackets to secure and space the awning tubes and form awning ribs permits custom manufacture of awnings in sets which will accommodate almost an infinite variety of length and permits altering the awning structure to make it longer or shorter simply by substituting a set 76*a–g* or more than one set of awning tube extensions and their associated support brackets. Standard first and second awning tube end sections will produce infinite length adjustment in combination with a particular length of a set of awning tube extension tubes. This greatly reduces the cost of manufacture and inventory and permits mass production. It might also be noted that the awning tube extensions exemplified by extensions 76*c*, 86*c*, do not necessary have to be straight and if appropriately curved to match the curve of the respective opposing end sections, can produce shapes varying from a section cut by intersecting perpendicular planes from a sphere to a variety of shapes similarly cut from a ovoid section.

Use of the support brackets and suitable connectors between the support brackets and the abutting tubes of each rib, provides a strong rigid structure which is free standing and may be assembled at the job site for installation as a complete unit or in sections. It is not even necessary to make exact measurements, for the end sections as illustrated in FIG. 5 can be assembled and mounted at the appropriate locations to fix the end position, then the intermediate distance can be filled in by the extension tubes to complete each awning rib, and if the extension tubes are slightly longer than desirable, the slots are long enough to accommodate some shortening of their length without interfering with the ability to be fastened and connected. Alternately, a sleeve can be used to connect awning tubes which could have a central portion of the same diameter, with a single threaded opening therein, and reduced diameter opposed end sections to fit inside the ends of abutting tubes, such that only one screw 74 and one opening 72 in the support brackets would be required. The abutting tubes can be adhesively joined to the reduced cross-section ends of the modified connector (not shown) or would not be drilled after assembly for self tapping screw connection. Since the notches 28 employed in such a case, it would be relatively easy to supply extra long extension tubes which can be simply measured at the job site and cut off.

A particular advantage of the support brackets, in addition to their supporting and stabilizing function is that the screws are located on the internal, or window side, of the awning structure and do not penetrate through the opposite side wall of the ribs. The ribs preferably have only butt joints which are exposed on the outside surface of the awning. Thus a smooth surface is presented for attachment of fabric or plastic type awning covers which are stretched over the frame to complete the installation. The lack of sharp protruding edges reduces the tendency of the ribs to wear the cover due to expansion and contraction and the effects of wind and rain.

It is particularly advantageous to fasten the awning structure in position through means for attachment which are connectable at one end to one or more of the elongated support brackets and at the opposite end to a wall mounted anchor bolt to secure the upper portion of the wallmost located awning tube adjacent the wall surface. In FIG. 5, the means for attachment comprises a cutaway section of the same awning support bracket shown in FIG. 6 where the flat portion 64 is, along with part of the groove 66, cutaway for attachment in juxtaposition with the outside surface of one of the grooves 66 of an elongated support bracket 62. It is conveniently fastened by the same screws 74 which are used to connect the support brackets 66 to the rib 36e. The opposite end of the support bracket may be tapered to a reduced width and provided with an opening to receive a hook from turn buckle 94. Turn buckle 94 in turn, has an oppositely oriented wall mounting hook for engagement in the eye opening of a bolt 96 which is fastened into wall 26. Depending upon the size and weight of the awning frame, a plurality of these fasteners may be desired. A turn buckle provides a means for adjustment to permit pivoting the upper portion of the assembled awning structure snugly against the wall and retightening, if necessary. Because the attachment means is located underneath one or more of the support brackets 62, they are not visible from the street and unobtrusive from inside the building. The use of a modified portion of the support bracket 62 makes for economical construction by reducing the number of fabricated parts. Additional ones can easily be fabricated in the field from extra support brackets.

Figure 10:
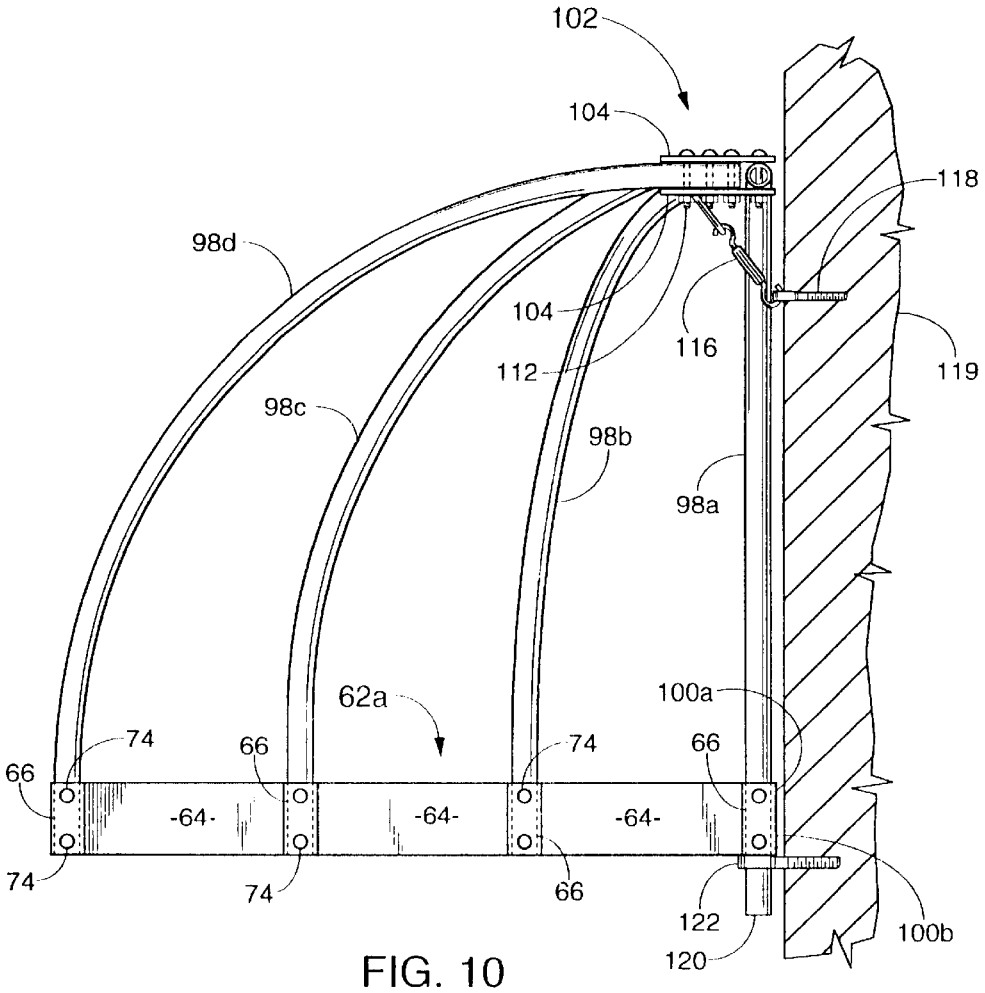
FIG. 10 shows a cutaway vertically oriented structure forming a half-round shape with the specialized support bracket forming the lower peripheral edge.
Figure 10A:
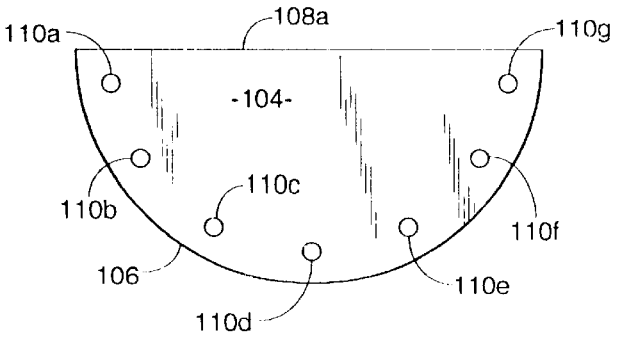
FIG. 10A shows a plan view of one of the top plates which forms the top bracket that holds the top ends of the tubes in the half-round structure of FIG. 10.

FIG. 10 shows a cutaway view looking from inside the awning towards one of its halves. The tubes are vertically oriented and except for the end tube lying with its axis parallel to the wall surface, the tubes extend outwardly and downwardly from the wall 119 to terminate in their lower ends which are shown connected to an elongated support bracket 62*a*. Bracket 62*a* is curved to form a half-circle adapted for receiving and securing the spaced apart lower ends of the set of vertically oriented tubes 98*a–b*, with the understanding that there are identical additional tubes 98 which continue around to form a complete half-circle/half-dome awning frame. The curved elongated support bracket has opposite ends 100*a* and 100*b* spaced below and on opposite sides of top bracket 102 proximate said wall when the top bracket is held against the wall.

Figure 10B:
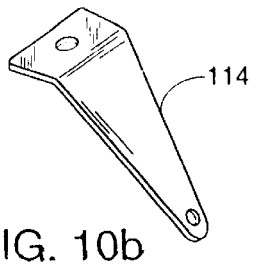
FIG. 10B shows a hanger to support the unit of FIG. 10 on a wall.

Elongated support bracket 62*a* is a band having spaced apart grooves 66 for receiving the lower terminal ends of the awning tubes 98 and is fastenable together by means of pairs of fasteners 74 to form a lower peripheral edge of the awning frame. Top bracket 102 is comprised of spaced apart plates 104 which are shaped like half-circles. Plates 104 have an arcuate edge 106 and a straight edge 108 for being placed proximate the wall surface. Along the arcuate edge is a line of mating fastener openings 110*a–g*, for fasteners to secure the upper ends of said tubes in a spaced apart radial array secured at the upper end by bracket 102. The wall top bracket 102 has plates 104 pressed against the upper ends of the awning tubes and fastened by fasteners, such as bolt 112. FIG. 10B shows a hanger 114 adapted to be connected to one of the plates of bracket 102 by a fastener, such as bolt 112, and having a turn buckle 116 for connection to a wall anchor 118 to adjustably support the upper portion of the awning frame. The end tube 98*a* at each side has a further end extension 120, beyond the peripheral edge of the support bracket 62*a* for insertion in the open head of fastening means 122 mounted in the wall, to support the assembled awning and hold it in place against the wall. By disconnecting the turn buckle the entire awning can be quickly and easily removed by raising it out of fastening means 122. It is understood that there will be two oppositely oriented end tubes 98*a* with extensions 120 to support each side of the half-dome awning of FIG. 10.

Figure 11:
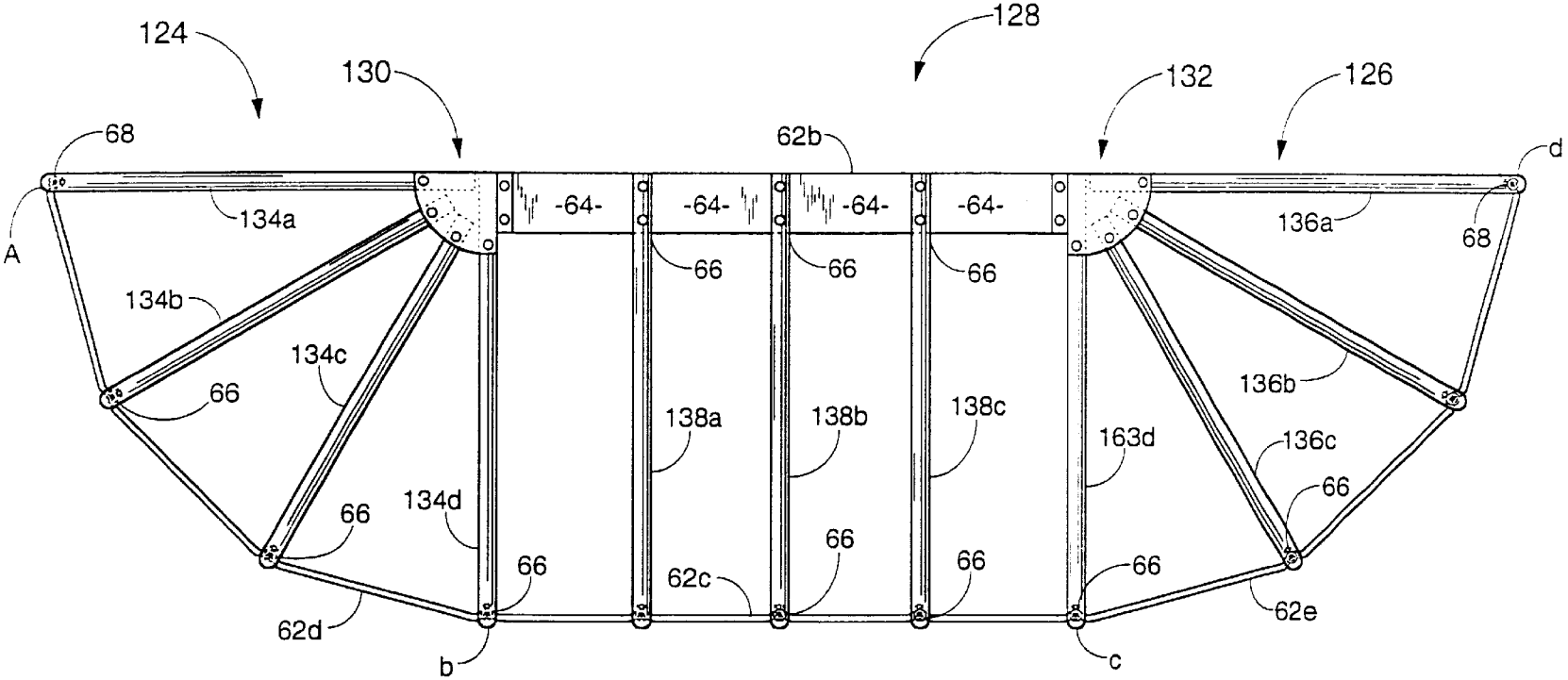
FIG. 11 is a top plan view of a modified structure of FIG. 10 having two quarter round end sections and a straight intermediate extension section.
Figure 12:
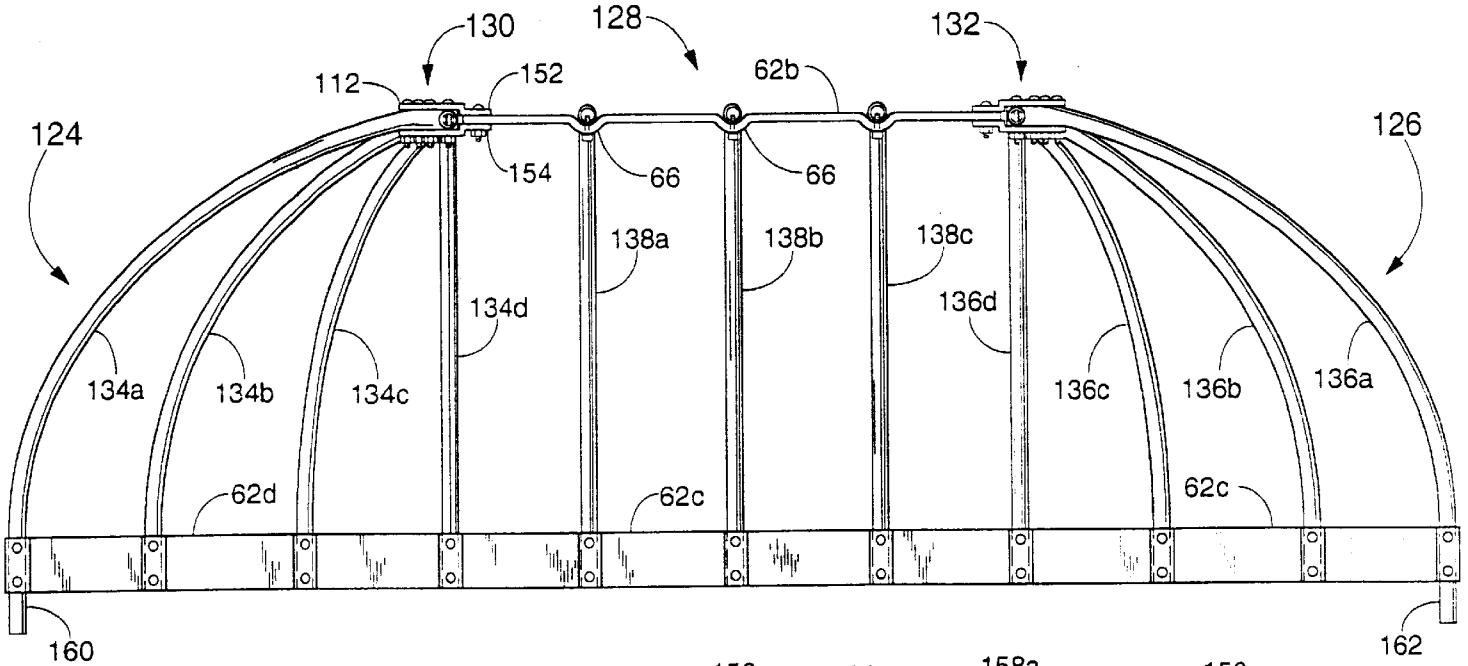
FIG. 12 is an elevation view of the awning frame structure of FIG. 11 looking out from the wall.

FIGS. 11 and 12 show another embodiment of the awning structure which is assemblable with fasteners for placement along a wall surface, having vertically running ribs comprising a first awning tube end section 124, an oppositely oriented second awning tube end section 126 and an intermediate awning tube section 128. The axis of said ribs lie in a vertical plane as assembled. First and second awning tube end sections are like two halves of the frame shown in FIG. 10 separated by the intermediate section except that slightly different first and second end brackets 130,132 are provided.

The first awning tube end section has vertically oriented awning tubes 134*a–d* arranged radially and depending outwardly and downwardly from first end bracket 130. The second awning tube end section has vertically oriented awning tubes 136*a–d* arranged radially and depending outwardly and downwardly from second end bracket 132. Intermediate awning tube section 128 has a straight section of elongated upper support bracket 62*b*. Connected thereto at spaced apart intervals is a plurality of outwardly and downwardly curved spaced apart awning tubes 138*a–c* having their wallmost ends secured to the straight section of support bracket 62*b* and their opposite other ends secured spaced apart by a means for connection to a straight portion of another lower support bracket 62*c*. Support bracket 62*c* has a curved first end section 62*d* adapted for connection to the terminal opposite ends of tubes 134*a–d* of the first end section. Another curved second end section 62*e* of lower support bracket 62*c* is adapted for receiving the lower terminal ends of the awning tubes 136*a–d* of the second awning tube end section 126. Intermediate awning tube section 128 can be shortened or lengthened or replicated to conveniently alter the completed awning length.

Figure 15:
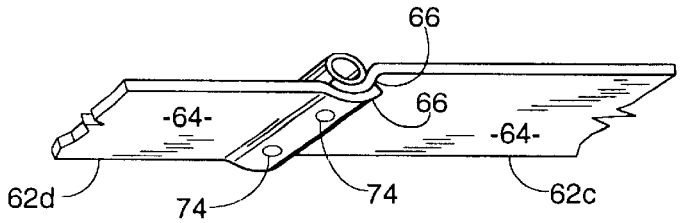
FIG. 15 shows overlapping grooved portions of the support bracket which forms a peripheral edge of FIG. 11.

Elongated support bracket 62*c* may be a band of continuous length from end to end indicated at A and D, or preferably may have an overlapping joint at B and C for connection as shown in FIG. 15. This facilitates compactness for shipping. The support brackets 62*a–e* are to be understood as identical in construction to the section of support bracket shown in FIG. 8 and previously discussed except for being bent or straight as shown between the spaced apart channels or grooves 66 which serve to receive the ends of awning tubes connected either singly or in overlapping arrangement as shown in FIG. 15. The wallmost grooves are referred to by the number 68 which are simply the grooves 66 with one of the flat extending portions 64 of the band removed.

Figure 13:
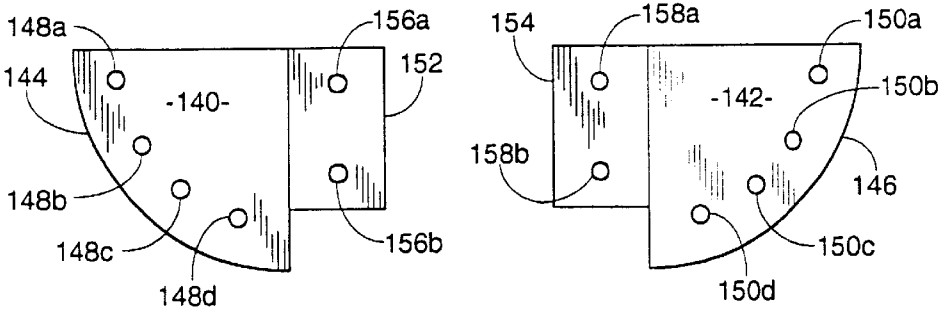
FIG. 13 is a top plan view of the plates which form the top side end brackets of FIG. 12.
Figure 14:
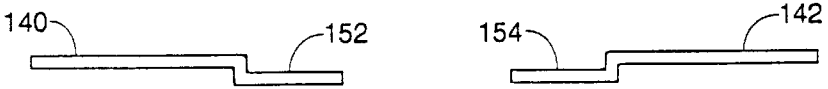
FIG. 14 is an end view showing the cross-section of the plate brackets of FIG. 13.

In FIGS. 13 and 14 are seen views of the left top end bracket late 140 and right top end bracket plate 142 which are mated spaced apart to form the first and second top end brackets 130, 132. They have a large portion having arcuate edges 144 and 146, respectively. Along the arcuate edges are a line of mating fastener openings 148*a–d* and 150*a–d*. Plates 140, 142 have offset flanges 152, 154 having pairs of fastener openings as indicated in FIGS. 13 and 14. FIG. 12 shows the first end bracket in assembly comprising oppositely oriented mated plates 140, 142 with the inside surfaces of the large portions against the upper end portions of the awning tubes 134*a–d* secured thereto by a fastener, such as bolt 112. The tube ends are adapted for receiving a fastener, such as bolt 112 which extends through the plates to secure the top ends of the tubes. The spaced apart flanges 152, 154 with the paired fastener openings are used to secure the end of the straight section of elongated support brackets 62*b* and a similar opposite connection is made on the opposite end with respect to the second top bracket which is connected in the same fashion.

Thus it is seen that the top ends of the awning tubes are connected through the use of the support brackets and spaced in a radial array with the endmost of the tubes located for placement along a wall surface and the opposite endmost tube of each of the first and second end sections at right angles thereto.

The free lower ends of the awning tubes of the first, intermediate and second sets are spread into an array of vertically oriented awning ribs to form the lower peripheral edge of an awning assembly together with the elongated support bracket 62*c* which is adapted with spaced apart grooves and fastener openings for receiving and securing the ends in a radial array of awning ribs.

As in previous embodiments, the endmost awning tubes 134*a*, 136*a* have respective further end extensions 160, 162, extending beyond the peripheral edge of the awning assembly created by the elongated support bracket, for insertion in a wall mounted fastening means to support the assembled awning and hold it in place against a wall. The extensions are ideally suited for removable placement in the head of an eye bolt mounted spaced apart in the proper place along the wall, with the weight being supported by the edge of the bracket itself and being held in position by the extension tubes received in the opening of the fixed supports. The upper portion of the awning frame shown in FIGS. 11 and 12 may be supported by an adjustable turn buckle bracket connection of the type shown in FIG. 10B. Thus the whole awning structure is easily installable, adjustably secured, and removable.

Figure 16:
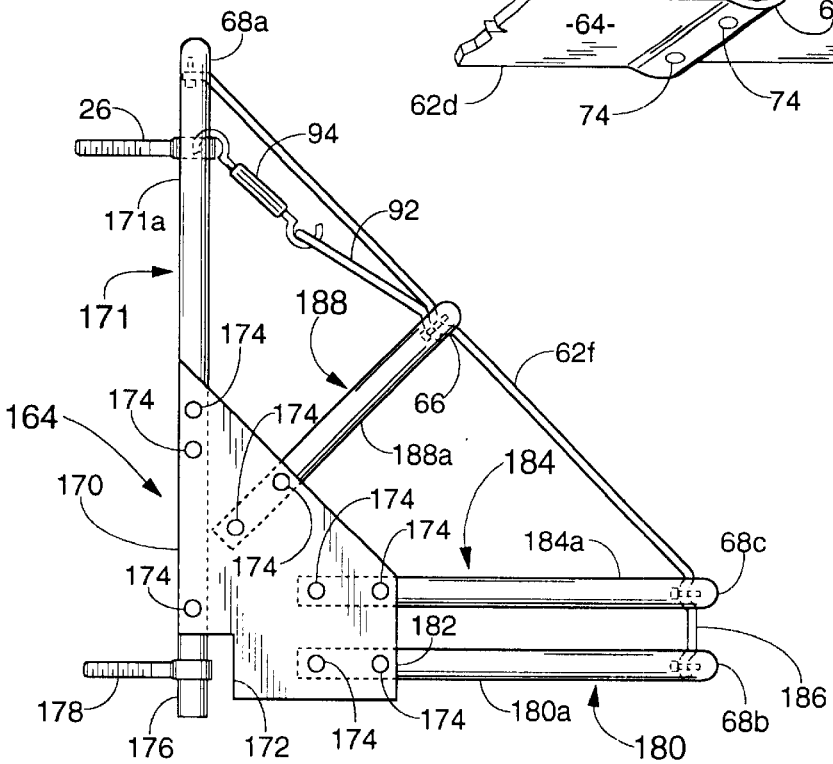
FIG. 16 is a side end view of a triangular-shaped frame.
Figure 17:
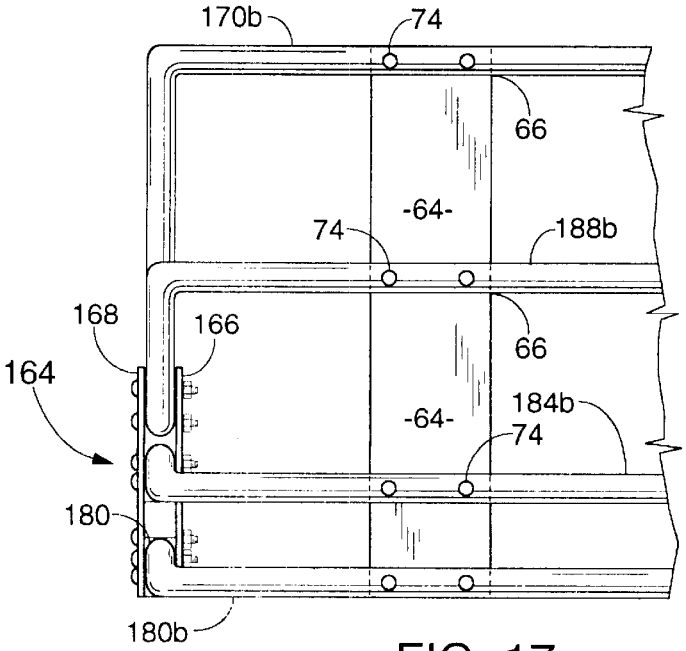
FIG. 17 is a cutaway front elevation of the side portion of the triangular frame of FIG. 16.

A still further embodiment is illustrated by FIGS. 16 and 17 which show a triangular arrangement which employs the same standard elongated support bracket 62*f* assembled with bent awning tubes and a modified end bracket 164. An opposite modified end bracket 164 would form the other side of the angular awning structure of FIGS. 16 and 17. Modified bracket 164 has a pair of complementary plates 166, 168 having appropriately located matching fastener openings for securing the tubes. Bracket 164 has a wall edge 170 and a notched opening 172. At the wall surface is a first awning tube 171 having a horizontal leg 171*b* and at opposite ends upright legs 171*a*. Through suitable matched openings in the opposing plates 166, 168, the upright 171*a* leg of the a first awning tube having a horizontal leg 171*b* is attached at each side by fasteners 174 leaving an extension 176 for being received in the open head of a wall mounted fastener 178. The same is true in the opposite side which is not shown. The structure has at least one second awning tube 180, in assembly having opposite horizontal legs 180*a* at right angles to said upright legs and extending outwardly from said brackets, said horizontal legs being connected at their outermost extension by a horizontal leg forming leg 18*b* extending therebetween. The right angled leg is identified as leg 180*a* and will have a corresponding leg on the opposite side which is not seen. The wallmost end 182 of legs 180*a* is fastened between the side-plates of bracket 164 by fasteners 174, the end of the tube being adapted for receiving said fasteners.

A straight section of elongated support bracket 62*f* having the same features as the support brackets 62*a–e* is seen having end portions 68*a*, 68*b* comprising a means for receiving and securing the horizontal leg 170*b* of the wallmost tube to the horizontal leg 180*b* of the bottommost tube. If a second additional horizontal tube 184, spaced apart and parallel to tube 180, having its ends secured between the bracket and fastened by fasteners 174 is employed, it may be anchored to the horizontal potion 184*b* at a terminal end 68*c* of a shortened or specially fabricated support bracket 62*f*. If a shortened bracket 62*f* is employed a short section 186 may be used to connect the tubes vertically at 68*b*, 68*c* by overlapping end of support bracket 62*f* at 68*c* in the manner revealed in FIG. 15. It could also be placed laterally displaced from support 62*f* with bracket 62*f* connected to tube 184*b* at 68*c*.

Another first additional awning tube 188 may be similarly connected at its ends to bracket 164 on both sides intermediate right angularly arranged tubes 170, 180 to support bracket 62*f* at a groove 66. It may be attached along with a short section of support bracket 92 and a turn buckle 94 for adjustable connection to a wall anchor 26 in a manner similar to that disclosed in the discussion of the adjustable support hanger of FIG. 5. As before, the fasteners do not extend through the outside wall of the awning tubes so that a decorative cover can be supported on the awning tubes to form a complete awning. The triangularly-shaped awning structures of FIGS. 16 and 17 can also be extended by the addition of extension tubes and additional support brackets in the manner disclosed in FIGS. 7 and 9 and using the connector system of FIG. 8. The awning can thus be lengthened by separating opposite end sections by the length of the extension members as previously indicated.

The awning is preferably made from galvanized metal or non-ferrous parts but may conveniently be made from any one of a variety of the commercially available structural plastics because the entire assembly is completed by fastening rather then welding. A particular and significant advantage is the ability to mass produce the parts, a relatively few number of parts being required, and the ability to package all of the parts required for even a large awning installation in a relatively small flat package which is compact. Custom fabrication is no longer needed to provide attractive commercial awnings.

I claim:

1. In combination with an assemblable awning frame structure of the type having opposed, first and second wall attaching side brackets, each supporting an array of radially extending awning tubes, wherein a distal end of each awning tube in the first array is bent so as to extend horizontally toward a distal end of the corresponding opposed awning tube in the second array, the improvement comprising:

a first elongated support plate extending transversely across the distal ends of the awning tubes of the first array, with each distal end fastened thereto;

a second elongated support plate extending transversely across the distal ends of the awning tubes of the second array, with each distal end fastened thereto; and lateral awning tubes of a selected length extending horizontally from each awning tube distal end of the first array to the corresponding opposed awning tube distal end of the second array and fastened to the transverse support plates so as to provide an awning frame structure of a desired width.

2. The combination with an assemblable awning frame structure of claim 1 wherein the lateral awning tubes of a selected length further comprise:

a plurality of abutting sets of lateral awning tubes, both ends of each tube configured for fastening to a transversely extending support plate; and a transversely extending support plate fastened to each abutting tube end in the abutting lateral tube sets.

3. The combination with an assemblable awning frame structure of claim 1 wherein the elongated support plates comprises a plurality of traverse channels, shaped to fit against the outside diameter of the awning tubes and spaced apart so that a channel is aligned with each distal end.

4. The combination with an assemblable awning frame structure of claim 1 wherein the fastening of the awning tube distal ends to the elongated support plates further comprises:

a hole in the elongated support plates corresponding to each distal end;

a slot in each awning tube wall extending from the distal end thereof;

a connecting bar fitting within the awning tube and having a transverse threaded hole therein; and a threaded fastener extending through the respective hole, through the distal end slot and screwed into the threaded hole so as to clamp the respective distal end to the elongated support plate.

5. The combination with an assemblable awning frame structure of claim 1 wherein said opposed, first and second wall attaching side brackets have side plates which each have a wall contacting edge with a notched section that is positioned against the vertical wall surface when the awning structure is assembled, to facilitate mounting and demounting.

6. The combination with an assemblable awning frame structure of claim 4 wherein the elongated support plates comprise a plurality of channels, shaped to fit against the outside diameter of the awning tubes and spaced apart so that a channel is aligned with each distal end.

7. The combination with an assemblable awning frame structure of claim 4 wherein the fastening of the elongated support plates to the lateral awning tubes further comprises:

a second hole in the elongated support plates corresponding to each distal end;

second slots in each lateral awning tube wall extending from each end thereof;

the connecting bar having a second transverse threaded hole therein; and a threaded fastener extending through the respective second hole, through a second slot and screwed into the second threaded hole so as to clamp the lateral tube end to the elongated support plate.

8. The combination with an assemblable awning frame structure of claim 5 further including the attachment of the elongated support plates to the vertical wall surface.

9. The combination with an assemblable awning frame structure of claim 6 wherein each spaced apart channel includes fastener openings for fasteners for clamping the slotted ends of two aligned tubes.

10. The combination with an assemblable awning frame structure of claim 8 wherein the attachment of the support plate to the wall surface is adjustable.

11. An awning frame kit, assemblable with fasteners to form a completed awning structure for mounting on a vertical wall surface, comprising:

a plurality of end section awning tubes, each having a mounting end and a distal end, the distal ends being bent to extend at a right angle from the mounting ends;

first and second wall attaching brackets configured to be placed in supported contact with a vertical wall surface, each bracket having an outwardly extending portion for respectively mounting radially extending first and second arrays of the end section awning tubes, the mounting being such that the distal ends of first end section awning tubes mounted on the first wall attaching bracket will be oriented to extend toward the respective distal ends of the second end section awning tubes mounted on the second wall attaching bracket;

a first elongated support plate to extend transversely across the distal ends of the first end section awning tubes, with means for fastening each distal ends of the first array thereto;

a second elongated support plate to extend transversely across the distal ends of the second end section awning tubes, with means for fastening each of the distal ends of the second array thereto;

lateral awning tubes of a selected length for extending horizontally from each end section awning tube distal end of the first array to the corresponding opposed end section awning tube distal end of the second array so as to provide an awning frame assembly of a desired width; and means for fastening the lateral awning tubes to the first and second support plates, so as to connect the lateral awning tubes to the respective distal ends.

12. The assemblable awning frame kit of claim 11 wherein the lateral awning tubes of a selected length further comprise:

a plurality of abutting sets of lateral awning tubes, both ends of each tube configured for fastening to a transversely extending support plate; and a transversely extending support plate fastened to each abutting tube end in the abutting lateral tube sets.

13. The assemblable awning frame kit of claim 11 wherein the elongated support plates comprise a plurality of transverse channels, shaped to fit against the outside diameter of the awning tubes and spaced apart so that a channel will be aligned with each distal end.

14. The assemblable awning frame kit of claim 11 wherein the means for fastening the awning tube distal ends to the elongated support plates comprises:

a hole in the elongated support plates corresponding to each distal end;

a slot in each awning tube wall extending from the distal end thereof;

a connecting bar fitting within the awning tube and having a transverse threaded hole therein; and a threaded fastener to extend through the respective hole, through the distal end slot and screw into the threaded hole so as to clamp the respective distal end to the elongated support plate.

15. The assemblable awning frame kit of claim 11 wherein said opposed, first and second wall attaching side brackets have side plates which each have a wall contacting edge with a notched section that is positioned against the vertical wall surface when the awning kit is assembled, to facilitate mounting and demounting.

16. The assemblable awning frame kit of claim 11 wherein the elongated support plates comprise a plurality of channels, shaped to fit against the outside diameter of the awning tubes and spaced apart so that a channel is aligned with each distal end.

17. The assemblable awning kit of claim 14 wherein the fastening of the elongated support plates to the lateral awning tubes further comprises:

a second hole in the elongated support plates corresponding to each distal end;

second slots in each lateral awning tube wall extending from each end thereof;

the connecting bar having a second transverse threaded hole therein; and a threaded fastener to extend through the respective second hole, through a second slot and screw into the second threaded hole so as to clamp the lateral tube end to the elongated support plate.

18. The assemblable awning frame kit of claim 14 wherein the elongated support plate comprises a plurality of channels, shaped to fit against the outside diameter of the awning tubes and spaced apart so that a channel is aligned with each distal end.

19. The assemblable awning frame kit of claim 15 further including means for attaching the elongated support plates to the vertical wall surface.

20. The assemblable awning frame kit of claim 18 wherein each spaced channel includes fastener openings for fasteners for clamping the slotted ends of two aligned tubes.

21. The assemblable awning frame kit of claim 19 wherein the means for attaching the support plates to the wall surface is adjustable.

* * * * *

UNITED STATES PATENT AND TRADEMARK OFFICE

CERTIFICATE OF CORRECTION

PATENT NO. : 6,267,130 B1
DATED : July 31, 2001
INVENTOR(S) : Katherine R. Konda It is certified that error appears in the above-identified patent and that said Letters Patent is hereby corrected as shown below:

Title page,
Item [54], Title, delete "ASSEMBLY" insert therefor -- ASSEMBLABLE --

Signed and Sealed this

Third Day of September, 2002

*Attest:*

*Attesting Officer*

JAMES E. ROGAN
*Director of the United States Patent and Trademark Office*